US008596608B2

(12) United States Patent
Grimseth et al.

(10) Patent No.: US 8,596,608 B2
(45) Date of Patent: Dec. 3, 2013

(54) SUB SEA HYBRID VALVE ACTUATOR SYSTEM AND METHOD

(75) Inventors: Tom Grimseth, Oslo (NO); Christian Borchgrevink, Langhus (NO); Jon Flidh, Mjøndalen (NO); Jan Olav Pettersen, Oslo (NO)

(73) Assignee: Veteo Gray Scandinavia AS, Sandvika (NO)

( * ) Notice: Subject to any disclaimer, the term of this patent is extended or adjusted under 35 U.S.C. 154(b) by 448 days.

(21) Appl. No.: 12/992,798

(22) PCT Filed: May 12, 2009

(86) PCT No.: PCT/IB2009/005567

§ 371 (c)(1),
(2), (4) Date: Feb. 10, 2011

(87) PCT Pub. No.: WO2009/138849

PCT Pub. Date: Nov. 19, 2009

(65) Prior Publication Data

US 2011/0126912 A1 Jun. 2, 2011

(30) Foreign Application Priority Data

May 14, 2008 (NO) ..... 20082217

(51) Int. Cl.
*F16K 31/122* (2006.01)

(52) U.S. Cl.
USPC ..... 251/69; 251/63.6; 251/68; 251/74; 251/101; 251/129.04; 91/43; 137/12; 137/14; 137/456

(58) Field of Classification Search
USPC ..... 251/62, 63.6, 66, 68, 69, 74, 101, 102, 251/129.04; 137/456, 12, 14; 91/43, 42
See application file for complete search history.

(56) References Cited

U.S. PATENT DOCUMENTS 2,834,569 A * 5/1958 Steele ..... 251/62
3,677,001 A * 7/1972 Childers et al. ..... 60/398

(Continued)

FOREIGN PATENT DOCUMENTS

GB 2433523 A 6/2007
NO 322680 B1 11/2006
WO WO-2006/068873 A1 6/2006

OTHER PUBLICATIONS

PCT/ISA/210—International Search Report—Sep. 4, 2009.

(Continued)

*Primary Examiner* — John K Fristoe, Jr.
*Assistant Examiner* — Minh Le
(74) *Attorney, Agent, or Firm* — Venable LLP; Eric J. Franklin

(57) ABSTRACT

A sub sea valve actuator system including a piston and cylinder assembly and a return spring arranged in an actuator housing, a hydraulic pump and electric motor assembly associated with the piston and cylinder assembly, and hydraulic flow lines for hydraulic medium driving the piston and cylinder in relative displacement against a force of the return spring. The valve actuator system includes a detector configured to detect an end-of-stroke position of the piston and cylinder assembly. The detector includes at least one of: a motor current monitoring circuit unit, a hydraulic medium pressure sensor unit, a position sensor unit, and a linear variable differential transformer unit. An electromechanical arresting mechanism is arranged to be energized for releasably arresting the return spring in a compressed state in result of the detected end-of-stroke position. A method for operation of a sub sea valve actuator system by which an end-of-stroke position for a piston and cylinder assembly in a sub sea valve actuator system can be determined.

19 Claims, 7 Drawing Sheets

(56) References Cited

U.S. PATENT DOCUMENTS

| | | | | | |
|---|---|---|---|---|---|
| 3,734,455 | A | * | 5/1973 | Natho et al. | 251/62 |
| RE30,115 | E | * | 10/1979 | Herd et al. | 251/63.6 |
| 4,423,748 | A | * | 1/1984 | Ellett | 137/315.29 |
| 4,650,151 | A | * | 3/1987 | McIntyre | 251/14 |
| 4,651,969 | A | | 3/1987 | Dowdall | |
| 4,827,963 | A | * | 5/1989 | Baker et al. | 137/75 |
| 4,934,652 | A | * | 6/1990 | Golden | 251/63.6 |
| 5,081,909 | A | * | 1/1992 | Hart | 92/14 |
| 5,228,473 | A | * | 7/1993 | Zink | 137/347 |
| 5,291,918 | A | * | 3/1994 | Johnson | 137/458 |
| 5,357,999 | A | * | 10/1994 | Loth et al. | 137/81.2 |
| 5,487,527 | A | * | 1/1996 | Eggleston | 251/62 |
| 5,497,672 | A | | 3/1996 | Appleford et al. | |
| 6,041,804 | A | * | 3/2000 | Chatufale | 137/15.23 |
| 6,182,678 | B1 | * | 2/2001 | Ma et al. | 137/15.17 |
| 6,487,960 | B1 | * | 12/2002 | Chatufale | 92/165 R |
| 6,572,076 | B1 | | 6/2003 | Appleford et al. | |
| 6,598,849 | B2 | * | 7/2003 | Hoang et al. | 251/62 |
| 6,609,533 | B2 | * | 8/2003 | Sundararajan | 137/15.19 |
| 7,231,934 | B2 | * | 6/2007 | Biester | 137/68.13 |
| 8,281,863 | B2 | * | 10/2012 | Voss | 166/351 |
| 8,308,129 | B2 | * | 11/2012 | Strange et al. | 251/69 |
| 2001/0023928 | A1 | * | 9/2001 | Green et al. | 251/62 |
| 2002/0134955 | A1 | * | 9/2002 | Konwinski | 251/68 |
| 2004/0113109 | A1 | * | 6/2004 | Silva | 251/30.01 |
| 2008/0083891 | A1 | * | 4/2008 | Holliday | 251/63.6 |
| 2008/0264646 | A1 | | 10/2008 | Sten-Halvorsen et al. | |

OTHER PUBLICATIONS

PCT/ISA/237—Written Opinion of the International Searching Authority—Sep. 4, 2009.

Norwegian Search Report—Nov. 29, 2008.

* cited by examiner

SUB SEA HYBRID VALVE ACTUATOR SYSTEM AND METHOD

CROSS-REFERENCE TO RELATED APPLICATIONS

This application claims priority to Norwegian patent application 20082217 filed 14 May 2008 and is the national phase under 35 U.S.C. §371 of PCT/IB2009/005567 filed 12 May 2009.

TECHNICAL FIELD OF THE INVENTION

The present invention relates generally to an actuator control system useful in sub sea production of hydrocarbons. It relates specifically to a sub sea valve actuator system and a method to achieve a simple and robust control system at low cost and low qualification effort. The actuator system is compatible with the concept of sub sea electric production control architecture.

BACKGROUND AND PRIOR ART

In the following background discussion as well as in the disclosure of the present invention, the following abbreviations will be frequently used:

BL brush-less
DC direct current
DCV directional control valve
EH MUX electro-hydraulic multiplexer
ESD emergency shut down
I/O input/output
LVDT linear variable differential transformer
PM permanent magnet
PSD production shut down
SIL safety integrity level
SHPU sub sea hydraulic power unit
SMA shape memory alloy
XMT, Xmas tree Christmas tree The prior art in control systems for hydrocarbon production comprises both hydraulic and electrical control, respectively.

Most concepts for electrical actuation of large gate valves include the use of an electrical motor and a roller screw or other form of rotary-to-linear mechanical conversion device, such as disclosed in e.g. U.S. Pat. No. 7,172,169 and in U.S. Pat. No. 6,572,076. Other concepts, such as disclosed in NO 322680, are based on use of a small SHPU, to combine the action of an electrical motor and a hydraulic piston/cylinder arrangement. Both approaches have merits and both also have certain limitations. The former approach tends to involve mechanical complexity and extensive instrumentation in non-retrievable components (i.e. for example integrated with an XMT module) and large dimensions. The latter approach tends to involve several hydraulic components demonstrated over many years to have less than desirable reliability in a sub sea context, e.g. DCV pilot valves requiring high fluid cleanliness for reliable operation, pressure relief valves and hydraulic accumulators. The latter, if in the form of nitrogen ($N_2$) charged bladder design, are prone to leakage over time, which is the reason they are normally carried on easily retrievable modules. In deep water $N_2$ charged accumulators are also inefficient. In the form of mechanical spring charged designs accumulators are bulky and unsuitable to be part of an actuator located on e.g. an XMT.

The present invention is based on a combination of principles pursued in both camps (roller screw and hydraulics) as per the above, and especially on the use only of the best components from each camp in a combination exhibiting unparalleled robustness and reliability combined with cost effectiveness.

The critical feature of a sub sea valve actuator as applied to e.g. an XMT is in the fail safe latch arrangement. This is a mechanism designed to work in conjunction with a return spring, the latter storing energy required to turn the valve from the production position to the safer position, usually from open to closed position.

For the case of electromechanical operation the latch is usually also electromechanical. Many versions have been devised, but few implemented and commissioned in the sub sea industry.

For the local (to the actuator) SHPU line of approach the fail safe feature is almost invariably provided by means of a DCV. Such valves have several unfortunate, but necessary design features. Traditionally the DCV has not been critical to the ESD functionality, except for a few installations characterised by very long offset of the sub sea production facility from the host platform. The universally accepted form of ESD for a traditional EH MUX production control system is in the form of hydraulic bleed down from the host platform, thus the safety critical DCVs are located on the host platform, and are thus accessible for repair or replacement.

Use of pressure relief valves sub sea has very little, if any, history in production control systems. The industry has shunned pressure regulating valves and pressure relief valves used sub sea. The full range of valves normally used in a mini SHPU dedicated to control of a single actuator are basically considered sensitive to particulate contamination and thus undesirable.

Electrical actuation should be defined in a system context, i.e. an actuator with only electrical (and possibly optical) interfaces, and no hydraulic interfaces, to the upstream parts of the production control system. FIG. 1 illustrates a typical prior art SHPU circuit pursued by several designers for achievement of an actuator using hydraulic components. The concept includes a pump driven by an electric motor, an accumulator for storage of hydraulic power, usually a filter for cleaning the fluid, and a solenoid operated DCV for directional control and a cylinder/piston unit. The latter is interfaced to the valve stem, providing the forces to bring the valve to the production position. A large return spring is usually provided for storage of the energy required to return the valve to the safe position when the hydraulic pressure is vented by the DCV when the solenoid is de-energized.

With reference to FIG. 1, it is customary to organise a motor 1 connected to a pump 3 via a flexible coupling 2 to generate a pressure and a flow through check valve 13 such as to charge an accumulator 8. A pressure relief valve 5 is arranged as indicated in FIG. 1 for protection of the pump and motor. Upon actuation, pilot valve 10 drives DCV 9 to the operating position to let fluid through connector 19 to actuator cylinder 11 and to drive a piston in cylinder 11 to the open position of the valve 12, also pushing fluid out from the spring side of the cylinder 11 through connector 20 and check valve 17 and filter 15. When the valve is to be returned to the safe position the solenoid of the pilot valve 10 is de-energized, the DCV 9 is driven under the force of the spring to vent the pressure in the cylinder 11 and the spring side of the piston sucks fluid from reservoir 7 through hydraulic connector 20 and check valve 18. The absolute pressure in the circuit is high for deep water and minor pressure drops across filters is of no consequence.

This circuit is suitable for a topside installation where the components most sensitive to contamination, notably DCV pilot valve 10 and pressure relief valve 5 may be accessed for repair or replacement, and where the ambient pressure at 1 bar is suitable for use of a nitrogen charged accumulator 8, but less suitable for a sub sea installation.

The present invention aims for elimination of these three undesirable components, but still providing an operable actuation system of great robustness and reliability.

In the following, several features of radical improvement on this concept with respect to reliability in operation will be described as parts of the present invention.

SUMMARY OF THE INVENTION

The object of the present invention is achieved and the drawbacks of prior art essentially eliminated by the valve actuator system and method.

In similarity with a conventional hydraulic actuator for a valve, the subject actuator comprises a cylinder/piston assembly and a return spring arranged in an actuator housing as the main elements. Also in similarity with a conventional hydraulic actuator the move from production mode to safe mode is by action of the return spring, and the move from safe mode to production mode is provided by means of hydraulic power generated in the auxiliary circuitry forming an integral part of the actuator concept, but preferably located in a separately retrievable unit.

The suggested circuit has no accumulator for storage of hydraulic power and no DCV pilot valve (or DCV). Nor has it a pressure relief valve. Thus the three least desirable components of the conventional concept have been eliminated. The motion of the piston/cylinder follows simply as a function of fluid being pumped into the cylinder directly from the discharge port of the pump.

The fail safe latch is an electromechanical arrangement (ref: electromechanical arresting mechanism). The arrangement comprises mechanical parts able to handle the reaction forces from the return spring and from the well bore pressure and is held in locked position by means only of a small electrical current and at a very low wattage. It is the introduction of this electro-mechanical fail safe arrangement which facilitates removal of the otherwise required components: accumulator (compensating for DCV leakage), DCV (essential function is to handle the ESD situation) and the pressure relief valve (protection of pump and motor). The fail safe latch arrangement only requires electrical power, no hydraulic power.

The present invention also facilitates protection of motor and pump by detection of end-of stroke position.

The present invention has characteristic performance very different from those of either an electromechanical actuator or an SHPU based actuator as described in the prior art references. It is truly an electric actuator as it has only electrical (and in the future possible optical) interfaces with the other parts of the production control system.

As opposed to a typical roller screw based actuator with a high torque brushless, permanent magnet, direct current (BL PM DC) motor and gear arrangements the proposed design may be built for larger diameter and shorter length protruding from e.g. the trunk of an XMT, thus more compatible with sub sea XMT architectures.

One advantageous feature of the valve actuator system of the present invention is that it can easily be expanded to serve fail-to-last position actuation, typically for a manifold or choke application, by simply reversing direction of rotation of the electrical motor, removing the fail safe spring and designing the piston/cylinder for bidirectional action. This assumes full reversibility of the pump, usually the case for a gear pump, not always the case for a piston pump. In the case of a piston machine it would be beneficial to use a motor as pump as they are usually designed for true bidirectional operation both in pump and motor mode.

Briefly, the present invention provides a sub sea valve actuator system comprising a piston and cylinder assembly and a return spring arranged in an actuator housing, a hydraulic pump and electric motor assembly associated with the piston and cylinder assembly, hydraulic flow lines for hydraulic medium driving the piston and cylinder in relative displacement against the force of the return spring. The actuator system is characterized by detection means arranged for detecting an end-of-stroke position of the piston and cylinder assembly, said detection means is at least one of:

a motor current monitoring circuit unit;

a hydraulic medium pressure sensor unit;

a position sensor unit; and a linear variable differential transformer unit;

wherein an electromechanical arresting mechanism is arranged to be energized for releasably arresting the return spring in a compressed state in result of the detected end-of-stroke position.

According to a preferred embodiment, at least one of the motor current monitoring circuit unit and the pressure sensor unit is contained in an electronics canister which is retrievably connected to the actuator housing.

According to another preferred embodiment, components of at least one of the position sensor unit and the linear variable differential transformer unit is contained in the actuator housing (i.e. the non-retrievable part of the actuator system).

The motor current monitoring circuit unit is preferably arranged to submit an end-of-stroke signal to a logic unit controlling the electromechanical arresting mechanism to hold the valve in production mode against the force of the return spring.

The pressure sensor unit is preferably arranged to generate a pressure signal in a logic unit controlling the electromechanical arresting mechanism to hold the valve in production mode against the force of the return spring.

At least one of the position sensor unit and the linear variable differential transformer unit is preferably arranged to submit an end-of-stroke signal to a logic unit controlling the electromechanical arresting mechanism to hold the valve in production mode against the force of the return spring.

Preferably, the hydraulic pump and electrical motor assembly are assembled in a hydraulic power unit which is retrievably connected to the actuator housing.

The hydraulic medium is preferably supplied to the piston/cylinder assembly from a reversible, fixed displacement hydraulic pump.

The hydraulic medium is also preferably supplied via a flow line opening in the end of the piston which preferably is stationary in the actuator housing.

The cylinder is preferably arranged displaceable on the piston in the actuator housing filled with hydraulic medium communicating with the hydraulic pump via a return flow line.

In a further preferred embodiment, the actuator housing comprises a stem projecting from the cylinder in a forward direction, and a locking bolt projecting from the cylinder in the aft direction, the locking bolt reaching through the piston to be releasably engaged, in the end-of-stroke position of the cylinder, by locking dogs arranged pivotally in the actuator housing.

The locking dogs are preferably controllable into locking engagement with the bolt upon energizing an electromagnet/solenoid or a shape memory alloy device.

Briefly, the present invention also provides a method for operation of a sub sea valve actuator system, comprising a piston and cylinder assembly and a return spring arranged in an actuator housing, a hydraulic pump and electric motor assembly associated with the piston and cylinder assembly, hydraulic flow lines for hydraulic medium driving the piston and cylinder in relative displacement against the force of the return spring. The method is characterized by the steps of:

- arranging an electromechanical arresting mechanism effective for releasably arresting the return spring in a compressed state;
- determining an end-of-stroke position of the piston and cylinder assembly through at least one of:
  - detecting the current supplied to/consumed by the electric motor;
  - detecting the pressure in the hydraulic medium;
  - detecting the position of the piston relative to the cylinder; and
  - detecting the absolute position of the piston or the cylinder; and
- energizing the electromechanical arresting mechanism in result of the detected end-of-stroke position of the piston and cylinder assembly.

Further subordinated method steps include:

- powering the motor at standstill in the end-of-stroke position while detecting at least one of the motor current consumption, the hydraulic medium pressure, the position of the piston relative to the cylinder, and the absolute position of the piston or the cylinder, and discontinuing the power supply to the motor (stator windings) upon detection of the end-of-stroke position of the piston/cylinder assembly;
- activating the electromechanical arresting mechanism upon passage of a certain delay in time during which the motor is stalled at full torque;
- accelerating the motor at minimum torque provided from a spring charged accumulator arranged in the flow of hydraulic medium from the pump to the cylinder;
- arranging at least one of a motor current monitoring circuit unit and a hydraulic medium pressure sensor unit in a separate retrievable electronics canister which is connectable to the actuator housing;
- arranging components of at least one of a position sensor unit and a linear variable differential transformer unit in the actuator housing.
- assembling the hydraulic pump and the electrical motor in a hydraulic power unit which is retrievably connected to the actuator housing.

Further features and advantages provided by the present invention will be appreciated from the following detailed description of preferred embodiments.

SHORT DESCRIPTION OF THE DRAWINGS

The present invention will be more closely explained with reference to the schematic drawings. In the drawings.

DETAILED DESCRIPTION OF PREFERRED EMBODIMENTS OF THE INVENTION

In the following preferred embodiments of the invention will be described. A complete list of references is attached to the end of the detailed description.

Figure 1:
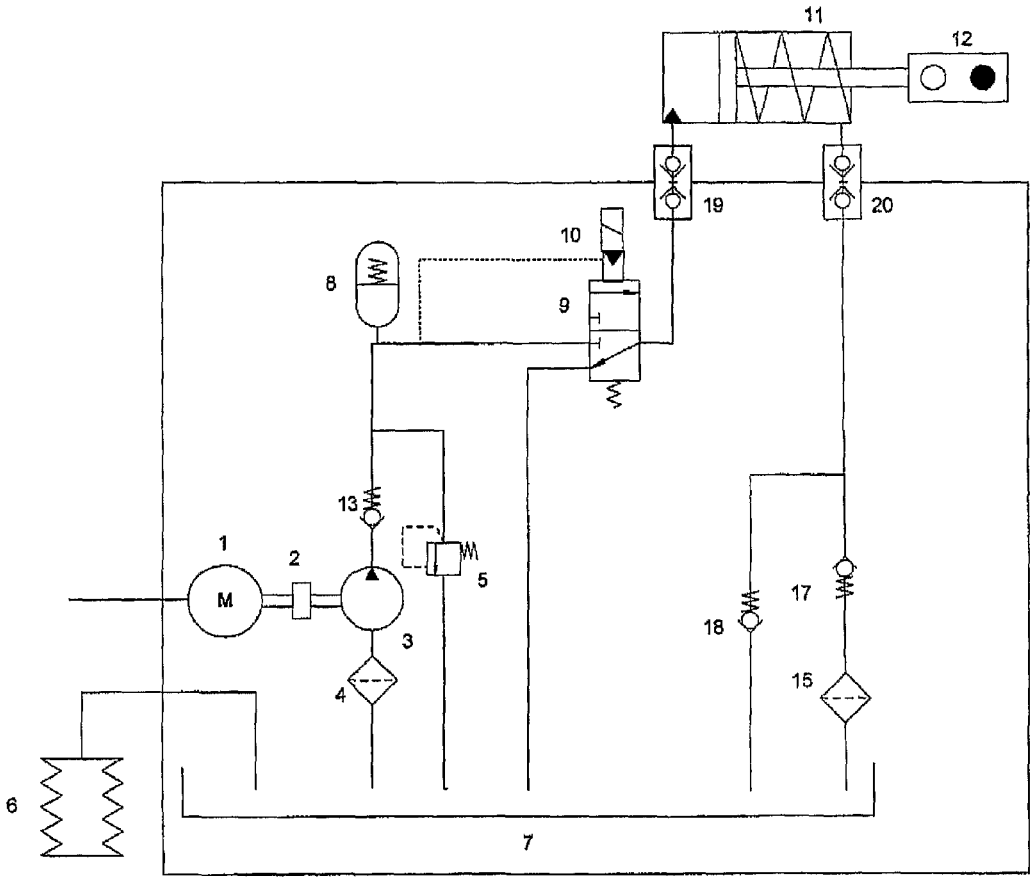
FIG. 1 illustrates schematically a traditional SHPU circuit often found in prior art designs where an SHPU is dedicated to operation of a single actuator.

With reference to FIG. 1, the prior art hydraulic circuit discussed in the background typically comprises the following components: an electric motor 1, flexible coupling 2, hydraulic pump 3, pump inlet strainer or filter 4, pressure relief valve 5, volume compensator 6, oil reservoir 7, hydraulic accumulator 8, control valve 9, pilot valve 10, hydraulic cylinder 11 with spring biased piston, gate valve 12, return filter 15, check valves 13, 17, 18 and hydraulic couplings 19 and 20.

Figure 6:
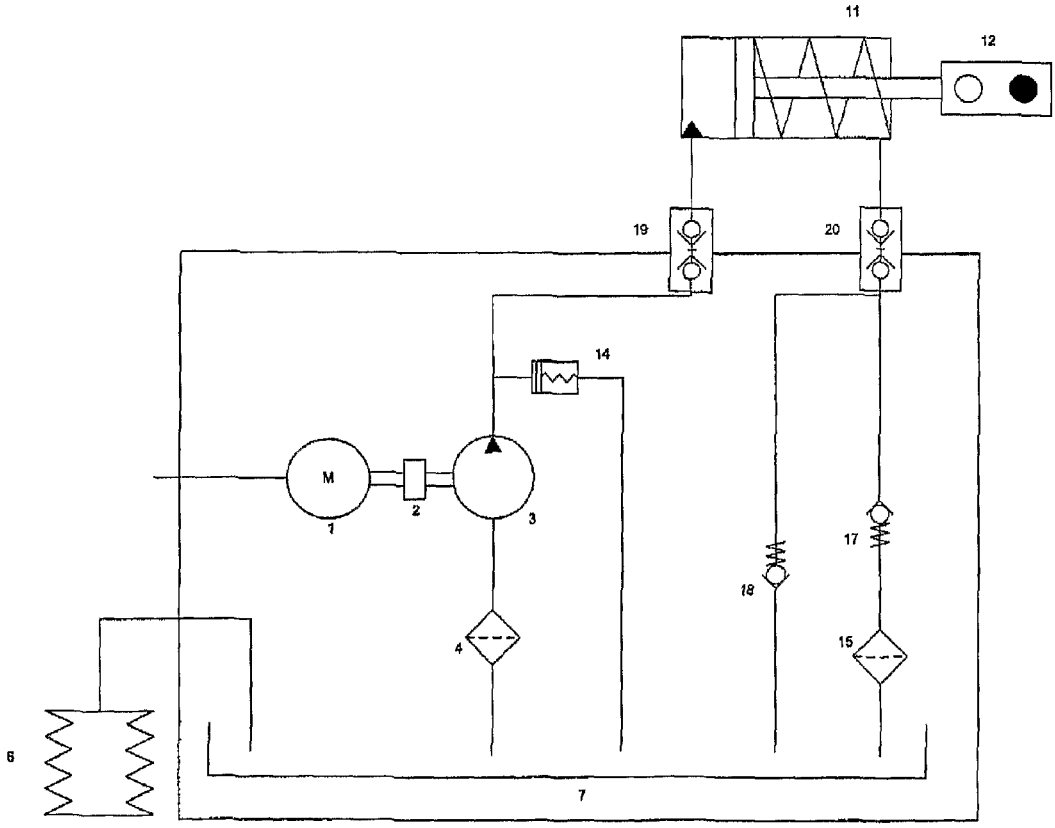
FIG. 6 illustrates schematically a hydraulic circuit of the actuator system according to a preferred embodiment of the present invention.
Figure 7:
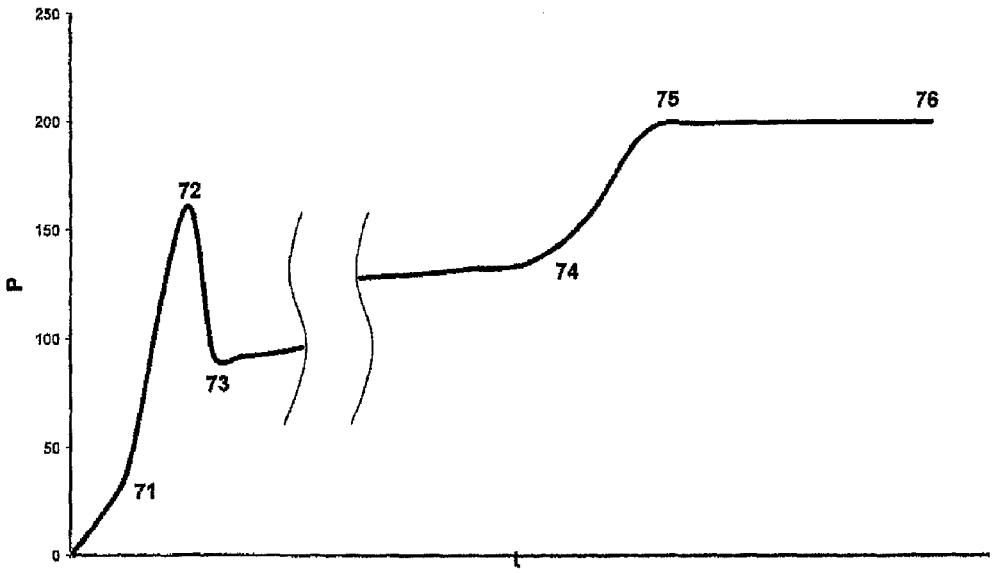
FIG. 7 is a representation of the hydraulic pressure in the actuator cylinder as a function of time for an actuator stroke sequence from safe to production position of the valve.

The simplified system of the present invention is correspondingly illustrated in FIG. 6. With reference to FIGS. 6 and 7, the motor 1 drives the pump 3 via flexible coupling 2 to create a pressure downstream the pump 3 as soon as the flow out of the pump is met with a restriction to flow. The least restriction to flow is represented by the small spring charged accumulator 14, organised to offer the motor a soft start at minimum torque, and thus allowing a fast acceleration of the motor rotor. This is similar to a hydraulic bypass type start, however without complicated control functionality which may introduce unreliability. The soft start is simply a piston type accumulator with a small spring, allowing fluid to be filled into the cylinder at low pressure until the cylinder is full and the piston is at end-of-travel. At this time, indicated at 71 in FIG. 7, the fluid is forced through connector 19 into the cylinder 11 in order to push the piston in cylinder 11 against the return spring so as to push the gate 12 to the production position. Reference number 72 indicates the breakaway position, and 73 indicates the start of steady motion when the breakaway force is overcome. When the production position is reached at 74, the pressure builds up downstream the pump because there is no outlet for the fluid. The rotor decelerates and is stalled at high pressure at time 75 and kept at full torque at (near) standstill for typically 1-2 seconds until time 76. During this stall time the arresting mechanism of the actuator is activated. The motor is then switched off, and the actuator is held in position by means of the arresting mechanism which counteracts the entire force of the return spring of the cylinder 11. During typically 1-2 seconds of stalling the rotor at full power supply, the heat generated in both rotor and stator is significant but well within the heat capacity of both components.

Figure 2:
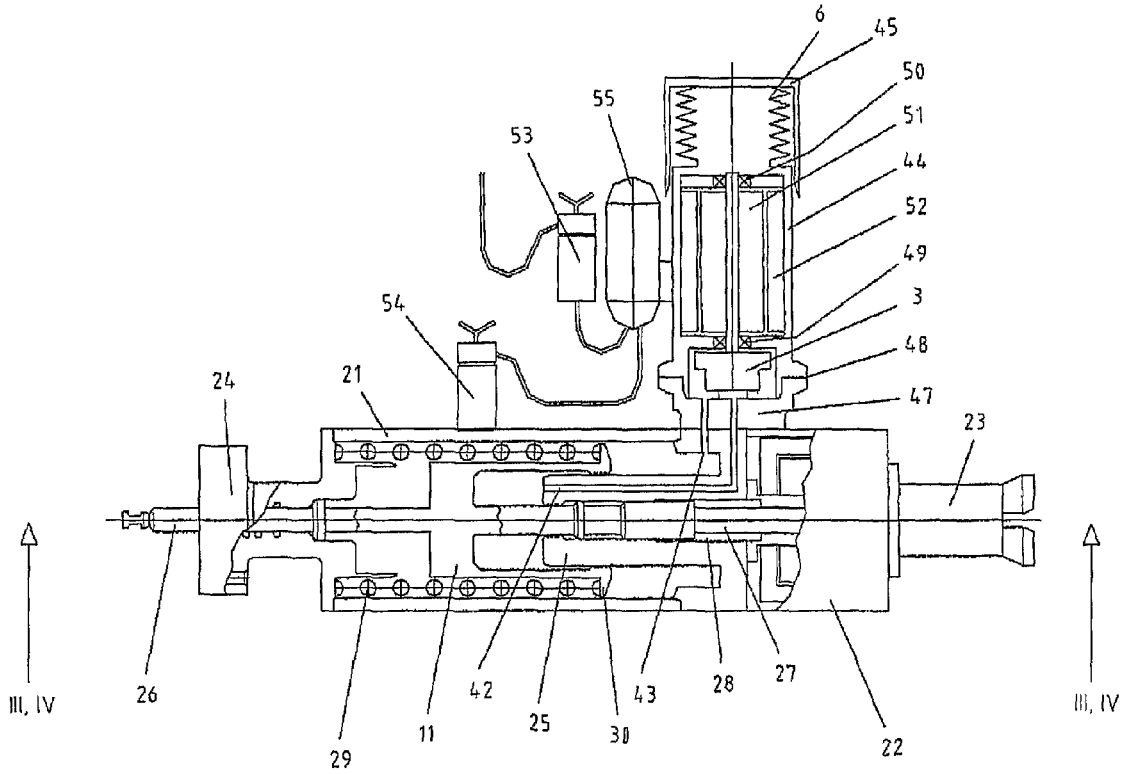
FIG. 2 is a longitudinal section through an embodiment of the actuator system of the present invention.

Turning now to FIG. 2, the structure and components of the sub sea valve actuator system will be described in more detail.

The actuator components are contained in a housing comprised of a forward housing part 21 connected to an aft housing part 22. Reference number 23 refers to an ROV override facility, and reference number 24 refers to an actuator bonnet, which connects the gate valve actuator to the gate valve and provides an end wall of the housing part 21.

A piston 25 and a cylinder 11 are arranged for relative displacement in the housing 21. More specifically, the cylinder 11 is arranged movable in both axial directions on a piston 25 which is stationary arranged in the housing. From a forward end wall of the cylinder 11, a stem 26 projects through the housing end wall or bonnet 24. The stem 26 provides a valve interface and is moveable linearly to effect shifting of the valve into production mode when the cylinder and stem are extended in the forward direction (i.e. towards the left hand side of the drawing). From the opposite side of the cylinder end wall, a locking bolt 27 projects into a bore 28 that is arranged centrally through the piston 25. The locking bolt 27 cooperates with an electromechanical locking or arresting mechanism as will be further explained with reference to FIGS. 3 and 4.

A return spring 29, such as a helical metal spring, is supported on the cylinder exterior and acting between the housing end wall/bonnet 24 and a radial flange 30 which is formed in the aft end of the cylinder 11. In extended position, the cylinder 11 will be biased in the aft direction by the power of the compressed return spring 29. The return spring 29 is releasably arrested in the compressed state through an electromechanical assembly comprising an electrically controlled trigger mechanism. In the compressed state of the return spring 29, see FIG. 3, the locking bolt 27 is arrested by engagement from a number of locking dogs 31 engaging a radial shoulder 32 that is formed on the locking bolt 27. The locking dogs 31 are preferably equidistantly spaced about the periphery of the locking bolt, and may be arranged at a number of two or more. The radial shoulder 32 connects an aft section of the locking bolt to a forward section 33 having greater diameter than the aft section. Upon release, see FIG. 4, the locking dogs 31 are pivoted out of engagement with the radial shoulder 32, thus allowing the locking bolt 27, the cylinder 11 and the stem 26 to be driven in the aft direction by the expanding return spring 29. The locking dogs 31 are formed in a forward face with a circular or semicircular recess, and are journalled to slide pivotally on a circular or semicircular sliding surface 34 formed in the opposite face of the piston. The locking dogs 31 are further formed, in an aft face thereof, with a curved sliding surface abutting a stationary structure in the housing, here referred to as a locking dog interface structure 35, which provides a sliding surface on an axial counter-support for the locking dogs 31.

Figure 3:
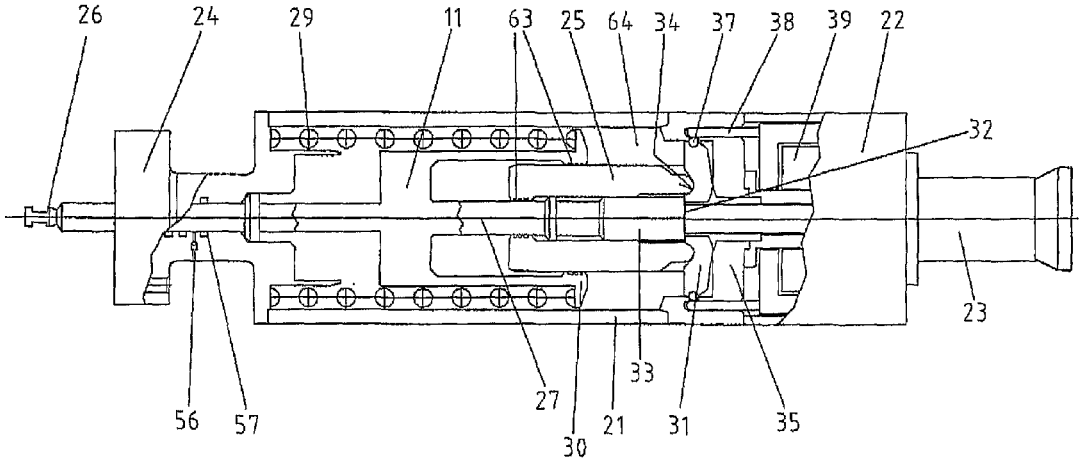
FIG. 3 is a sectional view along the line III-III in FIG. 2, showing the actuator in production mode.

The locking dogs 31 are formed with seats 36 in their peripheral ends. The seats 36 are shaped to receive, in the arrested state, a respective locking pin or locking ball 37 as illustrated in FIG. 3. The locking pins 37 are pushed in radial direction into the seats 36 by actuation rods 38 having rounded ends, which are operated to move axially in the forward direction by means of an electromagnet/solenoid, or in the alternative by an SMA (shape memory alloy) device 39. Thus, as long as the solenoid/SMA device 39 is energized, the actuation rods 38 remain extended to prevent the locking pins 37 from leaving the seats in the peripheral ends of the locking dogs 31. In the seated position, the locking pins 37 are clamped between the locking dogs 31 and a radial shoulder 40 (see FIG. 4) formed on the actuator housing, this way positively preventing the locking dogs from pivoting about the slide surfaces 34 formed in the end of the piston 25. When the solenoid or SMA device is de-energized, the actuation rods 38 are retracted in the aft direction, in the case of a solenoid by effect of a spring member (not shown). The locking pins 37 are then permitted to move in radial direction out from the seats 36, and are pushed by the pivoting locking dogs into recesses 41 (FIG. 4) which are made accessible in the retracted position of the actuation rods 38.

Figure 4:
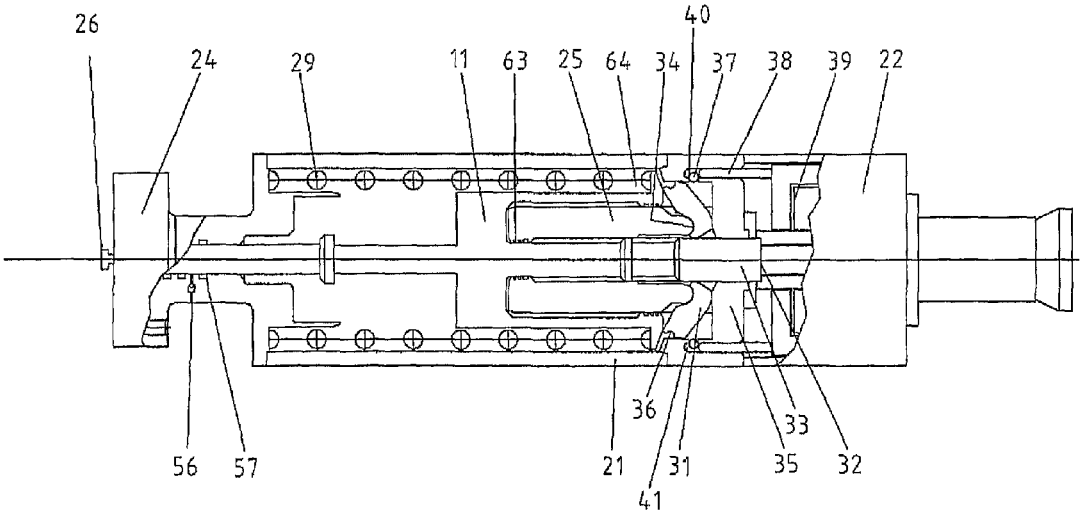
FIG. 4 is a sectional view along the line IV-IV in FIG. 2, showing the actuator in shut-in mode.

When the actuator is activated, the stem 26, cylinder 11 and locking bolt 27 are extended in the forward direction from the position illustrated in FIG. 4. Spring members (not illustrated) act on the locking dogs 31 for pivoting the same into the locking position illustrated in FIG. 3. When the locking dogs 31 are thus positioned with the seats 36 aligned with the locking pins 37 in recesses 41, the solenoid or SMA device 39 is energized in result of which the actuation rods 38 are extended in the forward direction and the locking pins 37 are pushed out of the recesses 41 and into the seats 36 by engagement from the rounded ends of the extended actuation rods 38.

Figure 5:
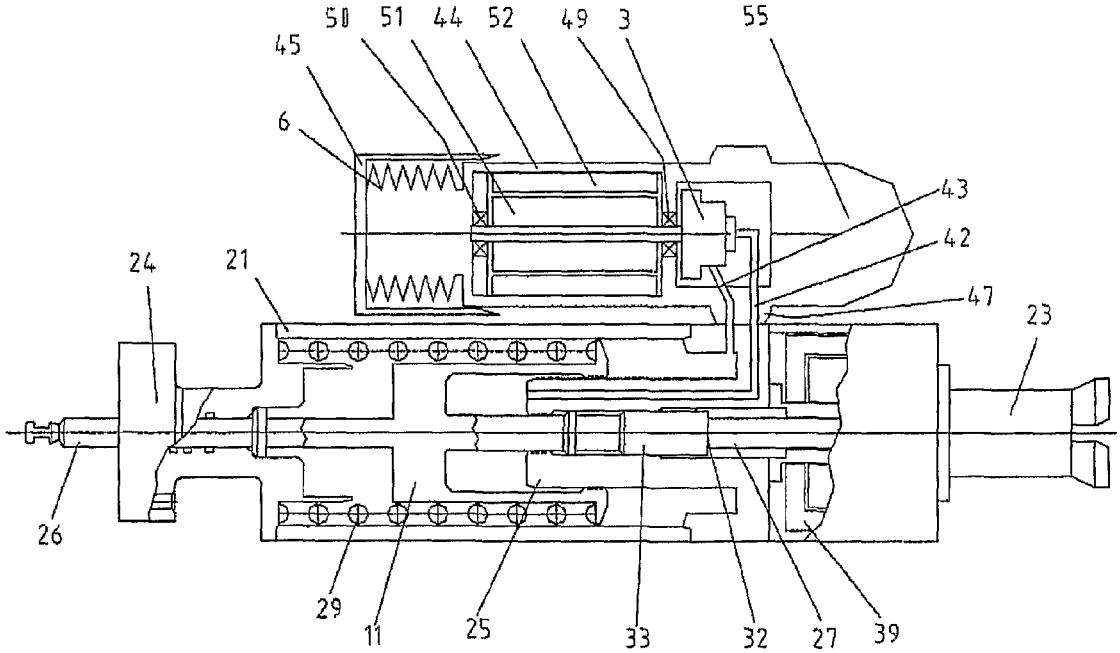
FIG. 5 is a longitudinal section through another embodiment of the actuator system of the present invention.

The piston/cylinder assembly 25/11 is powered by a hydraulic pump and electric motor assembly, see FIGS. 2 and 5. For reasons explained above, the pump 3 is of a fixed displacement reversible design which communicates hydraulic medium to the cylinder interior via a flow line 42 opening in the end of the piston 25, and to the actuator housing interior via flow line 43.

It should be noted that the preferred embodiment shows a movable cylinder 11 and an annular piston 25 fixed in position where the stem is in the centre. A more general case (see FIGS. 1 and 6) has a fixed cylinder and a movable piston. A preferred arrangement is an arrangement by which a stem connects all the way through to the ROV override facility. The practical adaptation is not critical for the invention, but is shown for completeness of description.

FIG. 5 illustrates a slightly modified modularisation of the actuator system shown in FIG. 2 with respect to the horizontal versus vertical orientation of the hydraulic power unit. The purpose of this embodiment is to reduce the diameter of the actuator design, protruding from e.g. an XMT trunk, to make it more compatible with XMT topology and space constraints. This embodiment may beneficially employ individual hydraulic stab connectors rather than the flange connection shown in FIG. 2.

A sub-sea hydraulic power unit SHPU is housed in a separate and retrievable SHPU-module comprising the motor and pump assembly encased in a housing 44. Reference number 45 refers to a protection cap for a metal bellows volume compensator 6, compensating for volume changes of the fluid in the actuator as a result of changes in pressure and temperature. Such devices are commonplace components in the sub sea industry and the component is shown for completeness of description. The SHPU connects to the actuator housing 21 via a connecting flange 47 and clamp interface 48. Reference numbers 49 and 50 refer to bearing arrangements journaling a rotor 51 for rotation relative to a stator 52. Electrical power and control is supplied from a host facility via lines connected to the gate valve actuator at wet mate connector 53. A supplementary connector 54 may advantageously be arranged for back up in a case where connector 53 is disconnected upon retrieval of the SHPU. Reference number 55 refers to a separately retrievable electronics canister housing the electric/electronics components necessary for operating the actuator.

The motor 1 can be designed in many forms. In a preferred embodiment of this invention a squirrel cage motor with the rotor 51 designed for very high resistance in the rotor bars is used. The bars could be made of a less conductive material than copper as opposed to the normal design of using copper, or the entire rotor can be a solid cylindrical piece of magnetic steel (in the latter case it is then strictly speaking not a squirrel cage anymore). This makes it possible for a motor of low efficiency when running at rated speed, but also for a motor of very low inrush current, high starting torque and very tolerant to heating. In the present invention efficiency of the motor running at rated speed (typically around 2900 rpm) is not a major issue, however, inrush current is a major issue in view of the long transmission lines used in sub sea field developments. Direct starting of the motor by means of conventional electromechanical contactors makes it possible for a robust scheme using simple equipment, but for a standard industrial induction motor of the squirrel cage design this tends to create large voltage drop on the transmission lines in response to large inrush currents and low load angle values at start-up. The motor only runs for 30-60 seconds per actuation, so the aggregated power loss in the form of heat is insignificant.

In the preferred embodiment the motor stator 52 is wound for very low voltages, typically 40-60 volts for a 5 kW unit (typical rating for a 5" actuator). Thus the insulation requirements are moderate making the motor functional even at poor insulation values. The entire housing containing the motor/pump and auxiliary valves is filled with a suitable mineral oil based or synthetic hydraulic fluid. All such fluids have excellent electrical insulation characteristics at low voltages, even when absorbing sea water. The hydraulic fluid is thus optimised on lubrication for the motor and pump bearings and performance of the pump in addition to corrosion resistance of the wetted components.

It should be noted that gear pumps have inherently an internal leakage, normally considered a disadvantage, in this context however considered an advantage, as the actuator is certain to go to the valve safe position even if the pump or motor were to freeze up on their respective bearings. In this unlikely case the shut in time would increase, but shut-in would eventually happen.

The pump 3 is in the preferred embodiment of a gear type design for robustness and cost effectiveness, but could also be of an axial piston type design or some other form of fixed displacement machine. The basic requirement is that the pumping action is reversible such that the pump is run as a motor under the pressure generated by the return spring 29 in cylinder 11 when the motor 1 is de-energised and the locking dogs 31 are released for shut-in. Thus the hydraulic circuit has intentionally no capability to hold the stem 26 in the extended position at pump standstill. Once the motor is de-energized and the locking dogs 31 are released, the return spring 29 will drive the stem assembly to the safe position of the valve. Only the mechanical fail safe mechanism (ref: electromechanical arresting mechanism) shown in FIGS. 3 and 4 is intended to hold the valve in the production mode. The electric motor and hydraulic circuitry only constitute the simple function of a jack device.

The check valves 17 and 18 are of non-critical nature. They are put in to make sure the fluid which alternately runs in and out of the cylinder spring side is passed through the filter 15 (typically a 3 micron unit), as springs are known to contaminate the fluid. The most common failure mode of a check valve is leakage when subject to pressure in the blocking direction. The check valves are not subject to pressure of significance. Minor leakages are of no consequence, as they will only result in a marginal reduction of the fluid filtration process. Obviously, adding another two, non-critical check valves to this circuit (not shown) results in also the fluid being sucked into the spring side of the piston being filtered (rectifier circuit). By the same token a similar arrangement may be made for the suction side of the pump (not shown).

The hydraulic circuit, shown in FIG. 6, is very robust with respect to particulate contamination which is usually considered the main source of failure in hydraulic systems.

Reference numbers 11, 23, 24, 26, 56, 57 as referred in the list, are considered self explanatory to sub sea engineers, and are not described further. The essentially new elements in FIGS. 2-5 are those related to the fail safe mechanism and to the SHPU part. These elements are new in a sub sea actuator context and essential features of the invention. The mechanical connection 47 between the ROV retrievable SHPU and the non-retrievable cylinder part 21, 22 is a common feature of sub sea systems and shown only for completeness. It would normally contain check valves in 47 for prevention of water contamination of the oil under mating/de-mating operations.

When the actuation stroke starts fluid flows from the pump 3 through the interface 47-48, 19, 20 into and through the piston to push the cylinder 11 to the extended position thus compressing the return spring 29. Upon reaching the end-of-stroke (or end-of-travel) of the piston/cylinder the locking dogs 31 are tilted into the locking position and the locking pins 37 are brought into engagement with the locking dogs by actuation of the electromagnet or SMA device acting on the actuation arms or rods 38 to push the pins/balls 37 into position. As long as the electromagnet/SMA device is energised the balls/pins 37 will bar the locking dogs from moving back to release the cylinder, irrespective of any practical force from return spring 29.

For completeness of description, seals 63 (piston seal packages) are also arranged in the interface between the cylinder 11 and piston 25 to separate the cylinder interior from the oil-filled interior 64 of the actuator housing 21.

Figure 8:
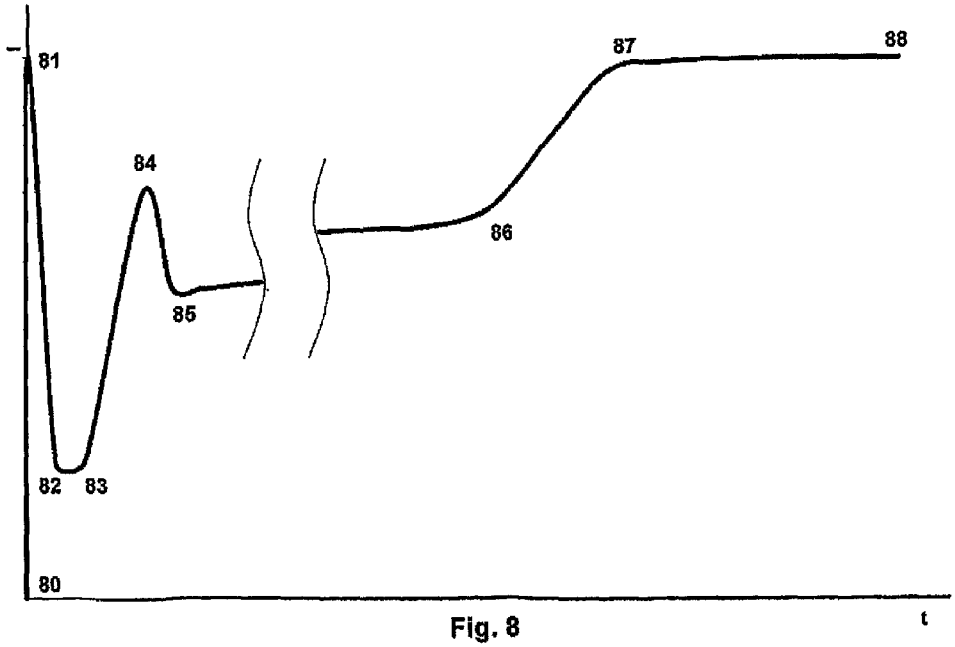
FIG. 8 shows the motor stator currents as a function of time over an actuator stroke.

FIG. 7 shows the development of hydraulic pressure in the actuator cylinder and FIG. 8 shows the corresponding motor stator currents, respectively, as a function of time for a typical actuation stroke sequence. When the motor is started it drives the pump against a low pressure 71 schematically represented by the spring force in the soft starter piston 14 (hydraulic accumulator 14 of piston type) (see FIG. 6). When the soft starter piston reaches end-of-travel (motor at full speed) the full breakaway force of the valve 12 is applied and the pressure increases from 71 to 72. The pressure is then immediately reduced as the piston 25 in the cylinder 11 starts to move against the force of the return spring 29 at 73. The pressure steadily increases as the return spring is being compressed and finally, when the piston in cylinder 11 reaches end-of-stroke at 74 the pressure sharply increases at 75 as there is no way out for the hydraulic fluid in the closed hydraulic system. The pressure is maintained with the motor rotor 51 nearly stalled and heat being developed in the rotor until the electromechanical arresting mechanism has been activated, say 2 seconds, measured by a simple timer. On signal from the timer the motor 44 is switched off and the circuit is depressurised, the pump now driving the motor in reverse.

Figure 9:
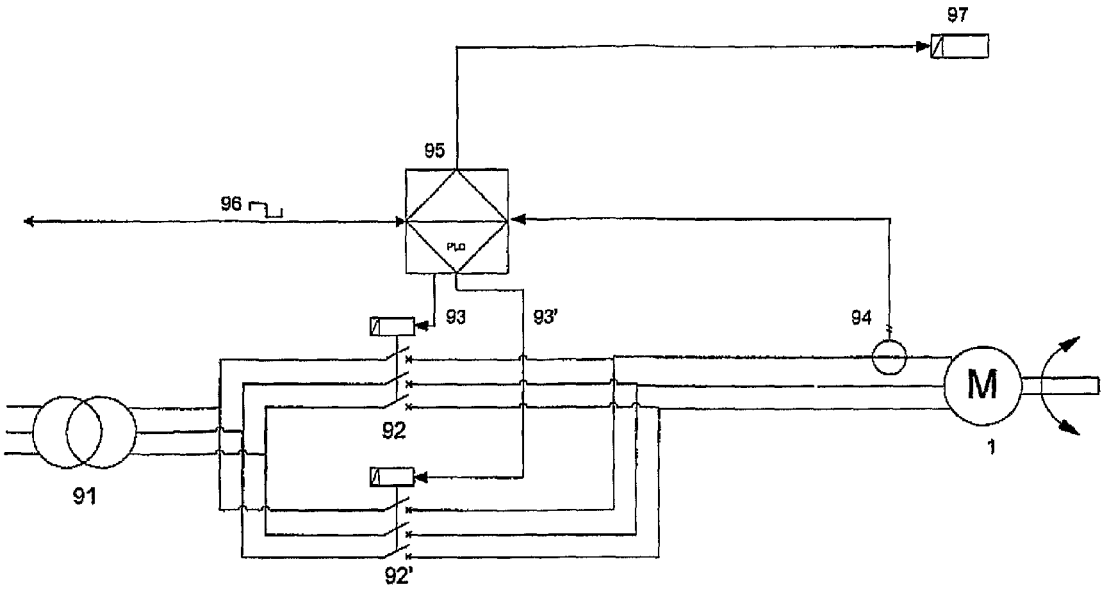
FIG. 9 is a principle schematic of the electrical circuitry of an actuator control system according to a preferred embodiment of the present invention.

In FIG. 8, reference number 80 indicates the starting point where the power is applied to the motor, and 81 is the point where the inrush current of the motor reaches its maximum value. Reference number 82 is the steady state at full motor speed, no-load value of the motor current, and 83 is the point where the soft start accumulator 14 hits end-of-stroke. Reference number 84 is the point where the breakaway force of the valve 12 is overcome, and 85 is the start of the stroke in steady motion. Reference number 86 indicates the end-of-stroke where the pump/rotor is decelerated to stalling (or very near stalling), and 87 is the point where the current supplied to the stator windings of the stalling motor. Finally, reference number 88 indicates the point where the locking dogs 31 have been activated and the motor power is switched off upon passage of a certain delay in time during which the motor 1 is stalled at full torque FIG. 9 schematically shows the electrical circuitry of an actuator control system according to a preferred embodiment of the present invention. Power is supplied from host facility via transformer unit 91. A motor current transformer 94 works with interface circuitry (not shown) to read back to a programmable logic controller unit (PLC unit) 95 the value of one or more electrical phase currents in the electrical motor. The PLC 95 is equipped with a normal serial communications line 96 and digital I/O control line 93 driving relays 92, 92'. On starting an actuation sequence the PLC unit receives a command from the topside installation via the various legs of the sub sea communication system (line 96) and pulls primary relay 92 to start the motor 1. The secondary relay 92' is installed for correction of the phase sequence and is in principle superfluous for an installation where correct wiring throughout is secured. Some operators may not accept dependence on such critical wiring. If the pump does not create a pressure when running this is indicative of erroneous phase connection. The secondary relay 92' may then be activated.

When the end-of-stroke is reached for the main piston 25 in the actuator cylinder 11 the electrical current detected by motor current transformer unit 94, and converted to a format readable to the PLC unit, is increased significantly (even for the case of an all iron rotor) since the rotor stalls. This is the signal for actuation of the latch solenoid unit 97 (39) or, as the case may be, the heater circuit of the SMA unit. A timer circuit in the PLC is activated to give the latch time to actuate and subsequently the relay 92 is deactivated by the PLC unit, thus de-energizing the motor.

Figure 10:
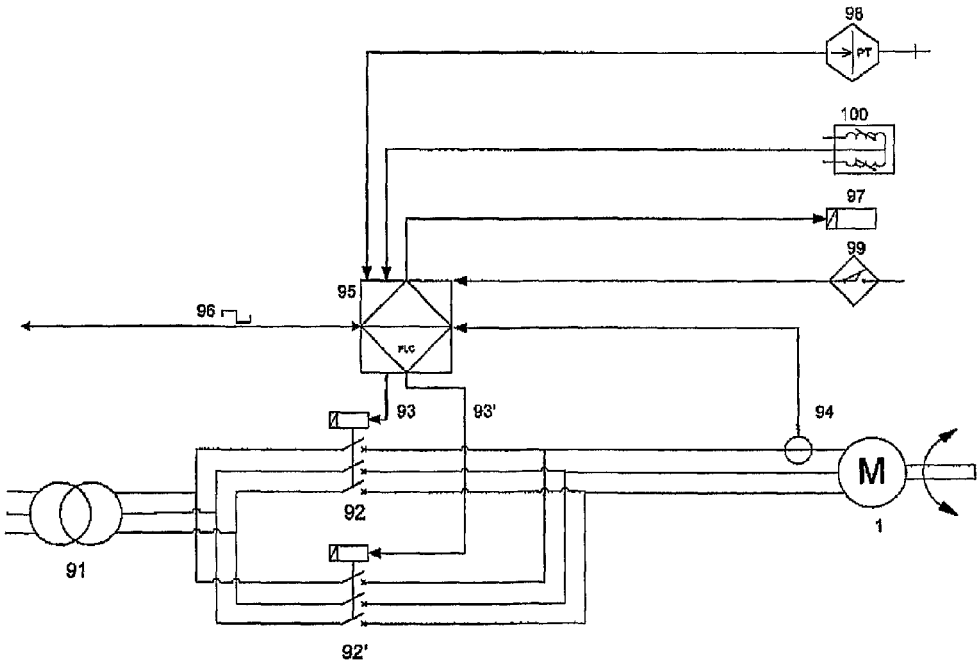
FIG. 10 is the control system of FIG. 9 extended to include alternative or enhanced sensor instrumentation.

FIG. 10 suggests alternative sensor instrumentation in other preferred embodiments of the present invention. This instrumentation may also be additional to improve the detection of end-of-stroke position with the primary inferential method described above, i.e. stator current detection through motor current transformer unit 94.

In a preferred embodiment a pressure sensor/transducer unit 98 is fitted at a place where the hydraulic pressure in the actuator is to be measured, e.g. to the pump outlet port tubing 42 (FIG. 2) (flowline for hydraulic medium) of the pump to detect at all times the pressure in the hydraulic fluid driving the piston/cylinder displacement. This pressure sensor unit will detect a pressure over time during an actuator stroke as shown in FIG. 7. Clearly this sensor unit will indicate end-of-stroke position of the piston/cylinder assembly and additionally provide inferential readings of valve position.

FIG. 10 also suggests a position sensor unit 99, intended for detection of end-of-stroke position of the piston/cylinder. This position sensor unit could be used as an alternative to the other types of sensor instrumentation or be combined with any of the sensor instrumentation for further improving the confidence in detection. A position sensor unit 99 of inductive type is a very simple instrument comprising a coil of wire, excitation circuit and a detector. The electronic circuit of the inductive position sensor unit 99 is embedded in the electronics canister 55 (see FIG. 2) and the coil of wire is preferably embedded in the non-movable part of piston/cylinder assembly, though not illustrated in the figures. A second position sensor unit of another type, typically magnetic or optical, could be installed to confirm end-of-stroke position or could be installed instead of a position sensor unit 99 of inductive type. Experience has demonstrated that position sensors are suitable in a sub sea environment.

Some operator companies wish to achieve direct position detection of the valve at all times, rather than indirect position detection by the inferential methods described above. This can be provided by means of a linear variable differential transformer unit (LVDT unit) 100 comprising coils of wire, excitation circuit and a detector in a conventional way by mounting the slider of the LVDT unit in direct mechanical contact to the stem of the valve actuator. The electronic circuit of LVDT unit is embedded in the electronics canister 55 (see FIG. 2) and the coils of wire are preferably embedded in the non-movable part of piston/cylinder assembly 11, though not illustrated in the figures.

Such arrangements are commonplace and have specifically been implemented on sub sea gate valve actuators. This implementation requires however considerable re-design as compared to the preferred embodiment of the LVDT implementation as schematically shown in FIG. 10. The issue is not whether the arrangement is feasible and practicable, the issue is more whether or not another electrical component, albeit robust, is to be embedded in a machine part which is for most cases difficult to retrieve for maintenance or replacement.

Both the pressure sensor unit 98 and the motor current monitoring circuit unit or motor current transformer unit 94 described above are located in a module or electronics canister 55 which is easily retrievable for maintenance or replacement by means of e.g. simple and proven ROV operations. Components relating to the position sensor 99 and the LVDT unit 100 have to be embedded in the non-retrievable part 21 of the valve actuator system. The preferred embodiments based on inferential detection of end-of-stroke position, i.e. motor current monitoring by means of a current transformer unit 94 or pressure sensing by means of a pressure sensor unit 98, requires only one ROV operated electrical connector 53 between the electronics canister 55 and the upstream power supply and communications centre (not shown). If either an LVDT unit or an inductive position sensor according to other preferred embodiments are implemented, then an additional ROV operated electrical connector 54 connecting electrical components in the cylinder part of the actuator with the electronic circuitry in the electronics canister 55 would be required. This represents additional cost and mechanical complexity, but represents well proven components and operations.

The invention is of course not in any way restricted to the embodiments described above. On the contrary, many possibilities to modifications thereof will be apparent to a person with ordinary skill in the art without departing from the basic idea of the invention such as defined in the appended claims.

LIST OF REFERENCES

1 an electric motor, in the preferred embodiments a squirrel cage or solid rotor design
2 flexible coupling
3 hydraulic pump, in the preferred embodiments a gear type
4 filter, typically a 50 micron particle size rejection pump inlet strainer
5 pressure relief valve (prior art)
6 volume compensator, in the preferred embodiments a bellows design
7 oil reservoir, typically defined by the external housing of the SHPU
8 hydraulic accumulator (prior art)
9 control valve (prior art)
10 solenoid operated pilot valve (prior art)
11 hydraulic cylinder
12 valve, such as a gate valve
13 check valve, in the position shown it is only referred to prior art

14 soft start hydraulic accumulator, piston type in preferred embodiments
15 return line filter
16 (not used)
17 check valve
18 check valve
19 hydraulic coupling
20 hydraulic coupling
21 forward portion of the actuator housing
22 aft portion of the actuator housing
23 ROV override facility
24 actuator interface bonnet
25 piston
26 valve interface/stem
27 locking bolt
28 aft section of the locking bolt
29 return spring
30 aft end flange on the cylinder
31 locking dogs
32 radial shoulder on the locking bolt
33 enlarged radius section of the locking bolt
34 locking dog sliding surface
35 locking dogs interface structure
36 seat formed in the peripheral end of the licking dogs
37 locking pin/ball
38 actuation rod for 37
39 solenoid or SMA actuation device
40 shoulder on the actuator housing
41 recess
42 flow line for hydraulic medium
43 flow line for hydraulic medium
44 motor/pump housing
45 metal bellows protection cap
46 (not used)
47 HPU flange
48 clamp interface
49 bearings
50 bearings
51 rotor of the electrical motor
52 stator of the electrical motor
53 wet mate connector
54 wet mate connector
55 electronics canister
56 port for venting leakage fluids from the production bore
57 stem main seal package
58-62 (not used)
63 piston seal packages
64 oil filled volume
65-70 (not used)
71 point on the pressure/time curve where the soft start accumulator reaches end-of-travel
72 curve on the pressure/time curve where the breakaway force in the valve actuator is overcome
73 point on the pressure/time curve where the piston in the cylinder 11 has overcome breakaway and started to move
74 point on the pressure/time curve when the actuator stroke is complete and the piston in cylinder 11 has reached end-of-stroke
75 point on the pressure/time curve when the pump/motor rotor is stalled or nearly stalled
76 point on the pressure/time curve when the latch actuation has completed its stroke
77-79 (not used)
80 starting point where the power is applied to the motor
81 maximum value of the inrush current of the motor
82 steady state at full motor speed, no load value of the motor current
83 point where the soft start accumulator hits end-of-stroke
84 point where the breakaway force of the valve is overcome
85 start-of-stroke in steady motion
86 end-of-stroke where the pump/motor rotor is decelerated to stalling (or very near stalling)
87 point where the stalled out current in the stator applies
88 point where the locking dogs have been actuated and the motor power is switched off
89-90 (not used)
91 transformer
92 primary relay
92' secondary relay
93 control line from the PLC unit input/output driving relay solenoids
94 motor current transformer unit
95 programmable logic controller unit (PLC unit)
96 communications line
97 latch solenoid
98 pressure sensor unit
99 position sensor unit
100 linear variable differential transformer unit (LVDT unit)

The invention claimed is:

1. A sub sea valve actuator system comprising:
a piston;
a cylinder assembly;
a return spring;
an actuator housing in which the piston, the cylinder assembly and the return spring are arranged;
a hydraulic pump;
an electric motor assembly, wherein the hydraulic pump and the electric motor are associated with the piston and cylinder assembly;
hydraulic flow lines for hydraulic medium driving the piston and cylinder in relative displacement against a force of the return spring;
a detector arranged to detect an end-of-stroke position of the piston and cylinder assembly, wherein said detector comprises at least one of:
a motor current monitoring circuit unit;
a hydraulic medium pressure sensor unit;
a position sensor unit; and
a linear variable differential transformer unit; and
an electromechanical arresting mechanism is arranged to be energized for releasably arresting the return spring in a compressed state in result of the detected end-of-stroke position.

2. The actuator system according to claim 1, further comprising:
an electronics canister in which at least one of the motor current monitoring circuit unit and the pressure sensor unit is arranged, wherein the electronics canister is retrievably connected to the actuator housing.

3. The actuator system according to claim 1, wherein components of at least one of the position sensor unit and the linear variable differential transformer unit are arranged in the actuator housing.

4. The actuator system according to claim 1, further comprising:
a logic unit configured to control the electromechanical arresting mechanism, wherein the motor current monitoring circuit unit is configured to transmit an end-of-stroke signal to the logic unit to hold the valve in production mode against the force of the return spring.

5. The actuator system according to claim 1, further comprising:
a logic unit configured to control the electromechanical arresting mechanism, wherein the pressure sensor unit is configured to generate a pressure signal in the unit to hold the valve in production mode against the force of the return spring.

6. The actuator system according to claim 1, further comprising:

a logic unit configured to control the electromechanical arresting mechanism, wherein at least one of the position sensor unit and the linear variable differential transformer unit is configured to transmit an end-of-stroke signal to the logic unit to hold the valve in production mode against the force of the return spring.

7. The actuator system according to claim 1, further comprising:

a hydraulic power unit retrievably connected to the actuator housing, wherein the hydraulic pump and electrical motor assembly are arranged in the hydraulic power unit.

8. The actuator system according to claim 7, further comprising:

a reversible, fixed displacement hydraulic pump configured to supply hydraulic medium to the piston and cylinder assembly.

9. The actuator system according to claim 8, further comprising:

a flow line opening in an end of the piston, wherein hydraulic medium is supplied via the flow line opening wherein the piston is stationary in the actuator housing.

10. The actuator system according to claim 9, further comprising:

a return flow line, wherein the cylinder is arranged displaceable on the piston in the actuator housing filled with hydraulic medium communicating with the hydraulic pump via the return flow line.

11. The actuator system according to claim 9, wherein the actuator housing comprises a stem projecting from the cylinder in a forward direction, and a locking bolt projecting from the cylinder in an aft direction, wherein the locking bolt extends through the piston to be releasably engaged, in the end-of-stroke position of the cylinder, by locking dogs arranged pivotally in the actuator housing.

12. The actuator system according to claim 11, further comprising:

an electromagnet/solenoid or a shape memory alloy device, wherein the locking dogs are controllable into locking engagement with the locking bolt upon energizing an the electromagnet/solenoid or the shape memory alloy device.

13. A method for operation of a sub sea valve actuator system, comprising a piston and cylinder assembly and a return spring arranged in an actuator housing, a hydraulic pump and electric motor assembly associated with the piston and cylinder assembly, hydraulic flow lines for hydraulic medium driving the piston and cylinder in relative displacement against the force of the return spring, the method comprising:

arranging an electromechanical arresting mechanism effective for releasably arresting the return spring in a compressed state;

determining an end-of-stroke position of the piston and cylinder assembly through at least one of:

detecting a current supplied to/consumed by the electric motor;

detecting a pressure in the hydraulic medium;

detecting a position of the piston relative to the cylinder; and detecting an absolute position of the piston or the cylinder; and energizing the electromechanical arresting mechanism in result of the detected end-of-stroke position of the piston and cylinder assembly.

14. The method according to claim 13, further comprising:

powering the electric motor at standstill in the end-of-stroke position while detecting at least one of the motor current consumption, the hydraulic medium pressure, the position of the piston relative to the cylinder, and the absolute position of the piston or the cylinder, and discontinuing the power supply to the electric motor upon detection of the end-of-stroke position of the piston and cylinder assembly.

15. The method according to claim 14, further comprising:

activating the electromechanical arresting mechanism upon passage of a certain delay in time during which the electric motor is stalled at full torque.

16. The method according to claim 14, further comprising:

accelerating the electric motor at minimum torque provided from a spring charged accumulator arranged in the flow of hydraulic medium from the pump to the cylinder.

17. The method according to claim 13, further comprising:

arranging at least one of a motor current monitoring circuit unit and a hydraulic medium pressure sensor unit in a separate retrievable electronics canister which is connectable to the actuator housing.

18. The method according to claim 13, further comprising:

arranging components of at least one of a position sensor unit and a linear variable differential transformer unit in the actuator housing.

19. The method according to claim 13, further comprising:

assembling the hydraulic pump and the electrical motor in a hydraulic power unit which is retrievably connected to the actuator housing.

* * * * *

UNITED STATES PATENT AND TRADEMARK OFFICE

CERTIFICATE OF CORRECTION

PATENT NO. : 8,596,608 B2
APPLICATION NO. : 12/992798
DATED : December 3, 2013
INVENTOR(S) : Grimseth et al.

It is certified that error appears in the above-identified patent and that said Letters Patent is hereby corrected as shown below:

Title Page, item (73) Assignee should read:

~~Veteo~~ Vetco Gray Scandinavia AS

Signed and Sealed this
Eighteenth Day of March, 2014

Michelle K. Lee

Michelle K. Lee
*Deputy Director of the United States Patent and Trademark Office*